US009103149B2

(12) United States Patent
Skotty

(10) Patent No.: US 9,103,149 B2
(45) **Date of Patent: *Aug. 11, 2015**

(54) AIR SPRING COUNTERBALANCE

(71) Applicant: The Chamberlain Group, Inc., Elmhurst, IL (US)

(72) Inventor: Brian Roy Skotty, Elmnurst, IL (US)

(73) Assignee: The Chamberlain Group, Inc., Elmhurst, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/467,081

(22) Filed: Aug. 25, 2014

(65) Prior Publication Data

US 2014/0360102 A1 Dec. 11, 2014

Related U.S. Application Data

(60) Continuation of application No. 14/079,716, filed on Nov. 14, 2013, now Pat. No. 8,813,429, which is a division of application No. 13/628,691, filed on Sep. 27, 2012, now Pat. No. 8,590,209.

(51) Int. Cl.
*E06B 3/00* (2006.01)
*E05D 13/00* (2006.01)
(Continued)

(52) U.S. Cl.
CPC ..... *E05D 13/10* (2013.01); *E05D 13/003* (2013.01); *E05D 13/12* (2013.01); *E05F 5/10* (2013.01); *E05F 15/59* (2015.01); *E05Y 2201/478* (2013.01); *E05Y 2900/106* (2013.01)

(58) Field of Classification Search
CPC ..... E05F 15/59; E05F 5/10; E05Y 2900/106; E05Y 2201/478; E05D 13/10; E05D 13/003
USPC ..... 49/197, 199, 200, 506, 138, 360, 445; 160/189, 190, 191, 192, 193
See application file for complete search history.

(56) References Cited

U.S. PATENT DOCUMENTS 666,170 A 1/1901 Webster
2,533,423 A 12/1950 Bunch
(Continued)

FOREIGN PATENT DOCUMENTS

CA 475597 7/1951
GB 2220982 1/1990

OTHER PUBLICATIONS

Airide Design Guide, Firestone Industrial Products Company, copyright 1992.
(Continued)

*Primary Examiner* — Jerry Redman
(74) *Attorney, Agent, or Firm* — Fitch Even Tabin & Flannery LLP

(57) ABSTRACT

Methods of operating a fluid-based spring counterbalance mechanism for a movable barrier are used to support a portion of the weight of the movable barrier. A jackshaft is configured to be operatively coupled to the movable barrier such that rotation of the jackshaft raises or lowers the movable barrier. The jackshaft is operatively coupled to a rotatable input shaft of the fluid-based spring counterbalance mechanism. The rotatable input shaft is coupled to a flexible-walled fluid-based spring. Applying a first force by a movable barrier operator changes the position of the movable barrier, and the flexible-walled fluid-based spring exerts a second force that supports a portion of the weight of the movable barrier in addition to the first force.

20 Claims, 15 Drawing Sheets

(51) Int. Cl.
*E05F 5/10* (2006.01)
*E05F 15/59* (2015.01)

(56) References Cited

U.S. PATENT DOCUMENTS

| | | | |
|---|---|---|---|
| 3,827,538 | A | 8/1974 | Morgan |
| 4,067,144 | A | 1/1978 | Ogishi |
| 4,102,382 | A | 7/1978 | Vesbach |
| RE30,308 | E | 6/1980 | Masser |
| 4,417,418 | A | 11/1983 | Warning |
| 4,649,598 | A | 3/1987 | Kinsey |
| 5,269,098 | A | 12/1993 | Redman |
| 5,285,596 | A | 2/1994 | Kinsey |
| 5,542,216 | A | 8/1996 | Mohler |
| 5,595,026 | A | 1/1997 | Licking |
| 5,706,606 | A | 1/1998 | Lin |
| 6,082,708 | A | 7/2000 | Mullican |
| 6,257,303 | B1 | 7/2001 | Coubray |
| 6,983,785 | B2 | 1/2006 | Altimore |
| 7,118,472 | B2 | 10/2006 | Kennedy |
| 7,219,711 | B2 | 5/2007 | Keller |
| 7,296,607 | B2 | 11/2007 | Krupke |
| 7,537,042 | B2 | 5/2009 | Altimore |
| 7,814,957 | B2 | 10/2010 | Crown |
| 8,590,209 | B1 | 11/2013 | Skotty |
| 8,813,429 | B2 | 8/2014 | Skotty |
| 2006/0096720 | A1 | 5/2006 | Krupke |
| 2011/0036646 | A1 | 2/2011 | Dack |
| 2011/0164920 | A1* | 7/2011 | Morgan et al. ..... 404/6 |
| 2013/0146235 | A1* | 6/2013 | Aquilina ..... 160/188 |

OTHER PUBLICATIONS

British Patent Application No. GB1317063.4; Combined Search and Examination Report Under Sections 17 and 18(3); Dated Mar. 28, 2014.

http://www.stengelbros.net/1S4-008-Goodyear-Sleeve-Air-Spring__p__5834.html; Printed out Mar. 21, 2011.

Internet Article Entitled "Garage Door Torsion Spring;" http//www.youdoitstore.com/Garage__Door__Springs__Torsion__s/4. htm; Printed out on Nov. 14, 2012.

Technical Sheet for Goodyear 1S4-008 Air Spring, Goodyear Engineered Products, available at least by Aug. 28, 2012.

Examination Report Dated Dec. 16, 2014 from New Zealand Patent Application No. 615845.

* cited by examiner

DYNAMIC DATA @ 7.0 in DESIGN HEIGHT

AIR SPRING COUNTERBALANCE

CROSS-REFERENCE TO RELATED APPLICATIONS

This application is a continuation of the previously filed U.S. patent application Ser. No. 14/079,716, filed on Nov. 13, 2013, to be issued as U.S. Pat. No. 8,813,429, which application is a divisional of the previously filed U.S. patent application Ser. No. 13/628,691, filed on Sep. 27, 2012, now issued as U.S. Pat. No. 8,590,209, both of which applications are incorporated by reference in their entirety as though fully rewritten herein.

TECHNICAL FIELD

This invention relates generally to movable barrier operators and more particularly to devices used to counter the weight of a movable barrier.

BACKGROUND

Movable barrier operators of various kinds are known in the art. Such movable barrier operators often work in conjunction with a corresponding movable barrier such as a single panel or segmented garage door, a rolling shutter, a pivoting, swinging, or sliding gate or arm barrier, and so forth. In particular, the movable barrier operator typically responds to user inputs (often as input via a remotely located user interface) to effect selective movement of a corresponding movable barrier (for example, to transition the movable barrier back and forth between a closed and an opened position).

A variety of mechanisms may serve to effect the movement of a movable barrier, including electric motors linked to the movable barrier through chain, belt, or screw driven mechanisms. Fluid-based operators that rely upon a rigid cylinder are also known in the art as a way to effect the movement of a movable barrier. These systems rely upon either hydraulic or pneumatic pressure to actuate a piston mechanically linked to the movable barrier. When hydraulic or pneumatic pressure increases in the rigid cylinder, the piston extends from the cylinder. Fluid-based operators have not gained popular success, however. Expense of the system components, labor intensive installation, specialized knowledge or tools required for installation, and the large amount of space required for such systems have prevented their popular adoption. Rigid piston and cylinder mechanisms are expensive to manufacture, requiring tight tolerances and specialized materials. Fluid-based operators also rely upon complicated mechanisms to translate the motion of a rigid cylinder into motion of the movable barrier. In many cases, these mechanisms require large amounts of space and are difficult to install and calibrate. Some of the known fluid-based movable barrier operators rely upon a second rigid cylinder to counterbalance the weight of the door. This configuration increases the costs associated with the fluid-based operator, because it requires duplication of expensive piston and cylinder components.

In conjunction with vertically lifted movable barriers, for example single panel or segmented garage doors and rolling shutters, counterbalance mechanisms are typically provided to reduce the effort required to lift the movable barrier. Counterbalance mechanisms that rely upon mechanical springs, such as torsion or extension springs, are known in the art, as are pneumatic mechanisms that rely upon a rigid piston and cylinder acting as an energy storage device.

An example prior art counterbalance mechanism will be described with reference to FIG. 10, which illustrates a vertically lifted garage door 1001, installed using methods known in the art. The garage door 1001 has rollers 1010 that run along tracks 1020 at either side of the door. The tracks 1020 guide each segment 1002, 1003, 1004, and 1005 of the door 1001 as the door 1001 is raised or lowered. The tracks comprise a horizontal portion 1021 generally parallel to the ceiling of the garage and a vertical portion 1022 generally parallel to the door opening. The segments 1002, 1003, 1004, and 1005 are connected to one another by hinges 1009. A jackshaft 1030 (sometimes also referred to as a torsion bar) is mounted above the garage door 1001. Cables 1032 attach at either side of the bottom of the garage door 1001 and run vertically along the sides of the garage door 1001. The cables 1032 are spooled around drums 1040 at either end of the jackshaft 1030. The interaction of the cables and the drums cause the jackshaft to rotate as the garage door is raised or lowered. As the door 1001 lowers, the cables 1032 unspool from the drums 1040 and extend down with the door 1001. Similarly, as the door 1001 is lifted, the cables re-spool around the drums 1040. A torsion spring 1035 is coiled around the jackshaft 1030 and exerts a rotational force on the jackshaft 1030 such that the shaft 1030 has a tendency to re-spool the cables 1032. Through the cables 1032, the spring 1035 pulls against the weight of the door 1000, which makes it easier to raise the door 1000. In effect, the arrangement of the torsion spring 1035, jackshaft 1030, drums 1040, and cables 1032 reduce the weight of the door 1000.

A garage door opener 1050 lifts and lowers the garage door 1001 by pulling a carriage 1051 along a lift track 1052 using a chain, belt, or screw. The carriage 1051 is connected to the garage door 1001 through a linkage 1053. As the garage door is raised, the weight of the segments 1002, 1003, 1004, and 1005 becomes supported as they move from the vertical portion 1022 to the horizontal portion 1021 of the garage door track 1020. In this way, the force required to lift the garage door 1001 becomes less as more segments pass along the horizontal portion 1021 of the garage door track. The prior art torsion spring 1035 accommodates this decrease in the weight of the garage door 1000 because it exerts less force as it relaxes. The torsion spring 1035 must be sized appropriately so that the reduction in its force corresponds correctly to the position of the garage door. Any one of several sizes of torsion spring 1035 could be required, based on the width of the garage door 1001 and the relative weight of the garage door 1001. For example, different springs 1035 would be required for a two-car garage than for single car garages. Likewise, wood doors are substantially heavier than foam-cored metal doors and therefore require different springs 1035. Because this type of counterbalance mechanism is a commonly installed system, there is a need for counterbalance mechanisms that can be retrofitted on these types of existing movable barriers systems.

Counterbalance mechanisms that rely upon mechanical springs are known to have sudden failures that can be disturbing for people in the vicinity. If the spring is not adequately secured during installation, or if the spring loosens during ordinary operation, it may snap loose as the movable barrier is lowered. Further, mechanical springs typically have a relatively short lifespan. The mechanical springs known in the art and used to counterbalance the weight of movable barriers commonly fail after as few as 10,000 cycles. Particularly in industrial and commercial door installations, the limited lifespan of mechanical springs requires frequent replacement of the springs. Replacing these mechanical springs is a labor intensive procedure that requires disassembly of the entire jack-shaft assembly. The mechanical spring is coiled around the outside of the jackshaft, so the only way to replace the spring is to remove the jackshaft completely and slide the spring off the end of the shaft.

When used as counterbalance mechanisms, mechanical springs require careful selection to match the weight of the door. The characteristics of the spring, such as spring constant and/or the displacement the spring is capable of, must be selected according to the weight and size of the door. Because these characteristics are fixed in a mechanical spring, manufacturers must stock a variety of springs.

Pneumatic counterbalance mechanisms that rely upon a rigid piston and cylinder suffer from the high costs associated with fluid-based movable barrier operators. The system components are expensive to manufacture and install for many of the same reasons discussed above.

In light of these disadvantages of the known current counterbalance and movable barrier operator systems, there is a need for a counterbalance mechanism and movable barrier operator that is robust and capable of a longer lifespan, that may be easily installed on existing jackshaft mechanisms, that reduces risks during installation and the likelihood of failure during use, and that may be installed using commonly available tools and knowledge.

BRIEF DESCRIPTION OF THE DRAWINGS

The above needs are at least partially met through air spring counterbalance approaches described in the following detailed description, particularly when studied in conjunction with the drawings, wherein.

Figure 1:
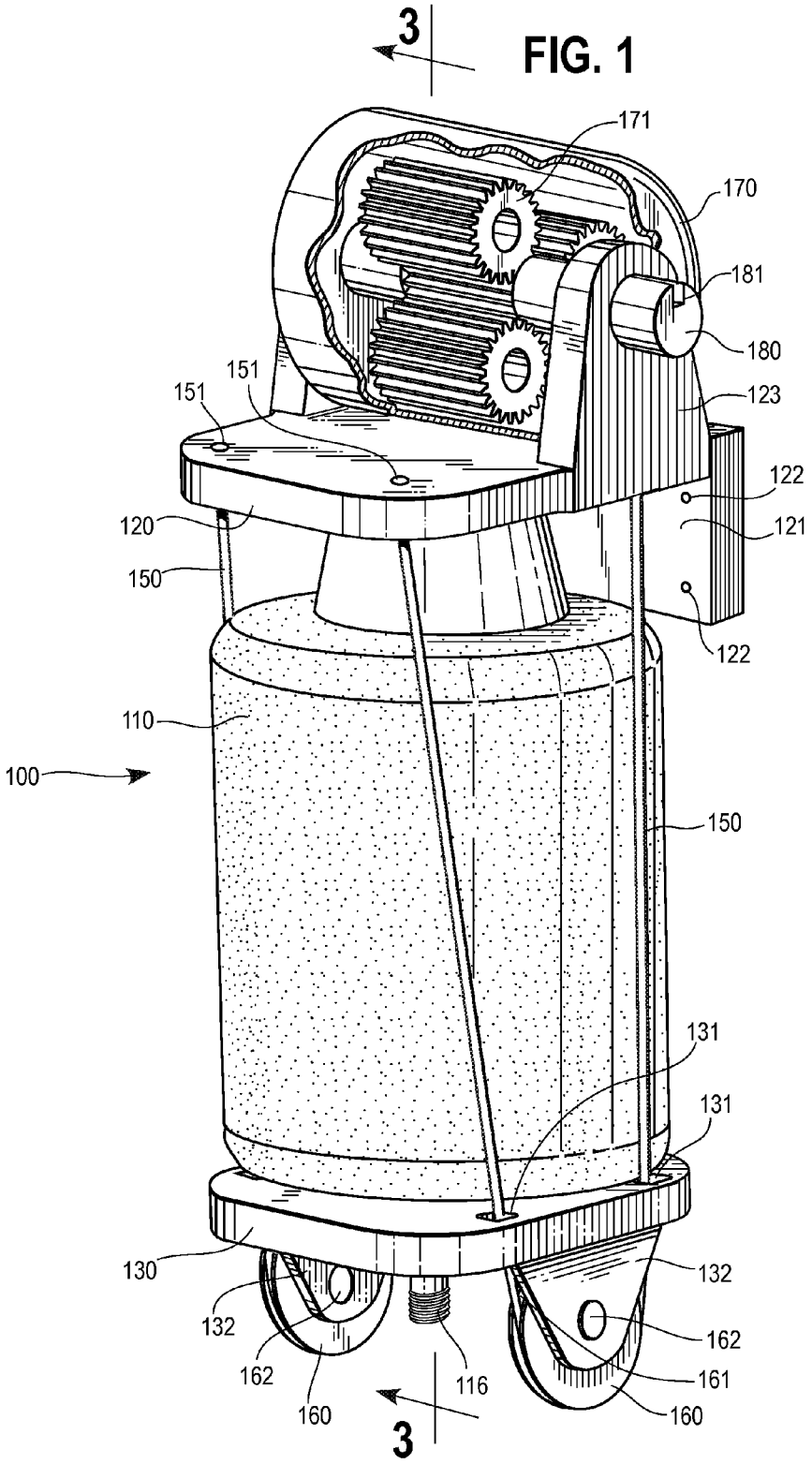
FIG. 1 comprises a perspective view of an example air spring counterbalance mechanism.
Figure 2:
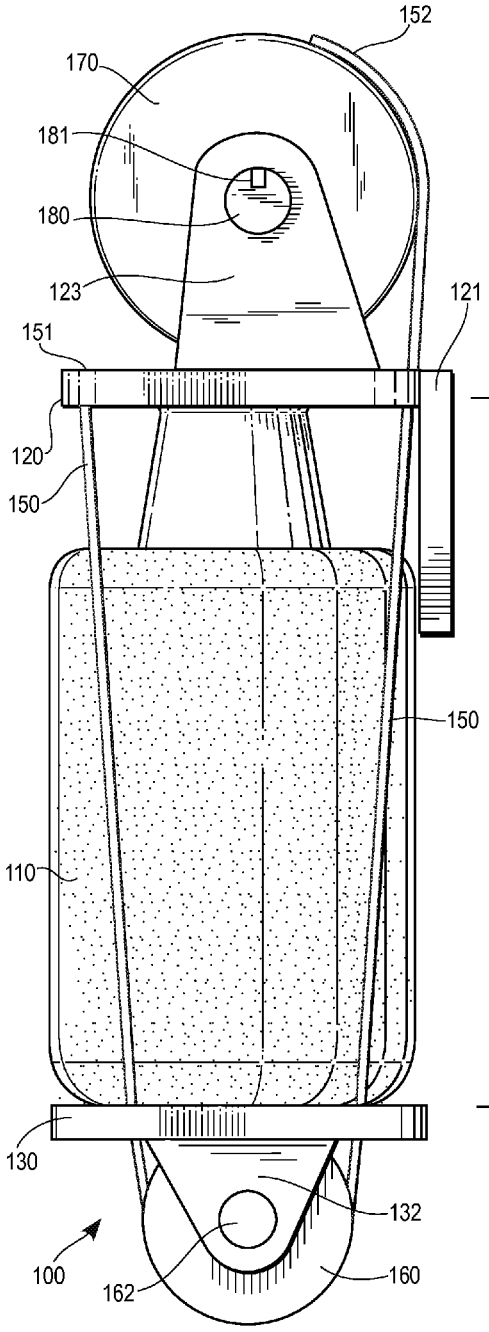
FIG. 2 comprises a side view of the air spring counterbalance mechanism of FIG. 1.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

Generally speaking, pursuant to these various embodiments, an air spring is mechanically connected to support the weight of a movable barrier. For example, the air spring is configured to exert a linear force, which is converted through a mechanical coupling into a rotational force that counterbalances the weight of the movable barrier through a jackshaft. More specifically, a fluid-based spring counterbalance mechanism including an elastic flexible fluid-based spring disposed between two surfaces is used to support some or all of the weight of a movable barrier. A linkage mechanism comprising at least one rotatable shaft is configured to receive rotational motion from a jackshaft associated with the movable barrier. A translational mechanism coupled to the at least one rotating shaft and coupled to at least one of the two surfaces is configured to compress the flexible fluid-based spring between the two surfaces in response to rotation of the rotatable shaft. By compressing the fluid-based spring, the counterbalance mechanism provides a force that partially or fully supports the weight of the movable barrier.

So configured, a single type of fluid-based spring such as an air spring can be configured to work with a variety of barrier types because the fluid-based spring's counterbalance effect can be controlled by adjusting the pressure within the spring. Accordingly, a minimal number of types of fluid-based spring systems can be applied to a large number of barrier types such that the spring to barrier matching problem is largely reduced or eliminated. Moreover, typical fluid-based springs can be expected to have a longer expected lifetime than the 10,000 cycle lifetime expected of typical mechanical torsion springs. Additionally, fluid-based springs are less likely to fail in a sudden event, instead gradually losing the ability to maintain a pressure sufficient to counterbalance a barrier. Such a failure mode provides an opportunity to replace a fluid-based spring before total failure of the system. These and other benefits will become apparent through study of the following description and accompanying figures.

Turning to the figures, an example air spring counterbalance mechanism 100 for a movable barrier is shown in FIGS. 1, 2, 3, and 4. A flexible fluid-based spring such as an air spring 110 is disposed between two surfaces. In this example, the two surfaces include a fixed plate 120 and a movable plate 130. A linkage mechanism includes at least one rotatable shaft 180 that is configured to rotate in response to movement of a movable object, such as the movable barrier. A translational mechanism is coupled to the at least one rotating shaft 180 and to at least one of the two surfaces 120 and 130. The translational mechanism is configured to compress the flexible fluid-based spring between the two surfaces 120 and 130 in response to rotation of the rotatable shaft 180 such that the counterbalance mechanism is configured to provide a force opposed to movement of the movable object.

In the illustrated example, the translational mechanism includes a cable 150 made of metallic wire rope or other suitably strong and flexible connecting material that is fixed at its first end 151 to the fixed plate 120. In other approaches, the cable 150 is fixed to the movable plate 130. The cable 150 passes through a hole 131 in the moveable plate 130 and over a pulley 160 having a groove 161 configured to support the cable 150. The pulley 160 rolls on a shaft 162 that is supported by flanges 132 that protrude from the bottom of the movable plate 130. In another approach, the flanges 132 supporting the pulley 160 protrude from the top of the movable surface 130, alongside the air spring 110. The second end 152 of the cable 150 is coupled to a drum 170. As the drum 170 rotates, it takes up the cable 150 and causes the movable plate 130 to compress the air spring 110 by reducing the distance between the fixed plate 120 and the movable plate 130. The combination of the two plates 120 and 130, along with the cable 150 and the drum 170, comprise a translational mechanism designed to compress the air spring 110.

In this example, the drum 170 is coupled through a planetary gear mechanism 171 to a rotatable shaft 180. The rotatable shaft 180 is supported by flanges 123 that protrude from the top surface of the fixed plate 120. The rotatable shaft 180 may include a keyway 181 or other indexing feature used to link the shaft 180 to other shafts, including the jackshaft 1130 described with respect to FIG. 11.

Figure 11:
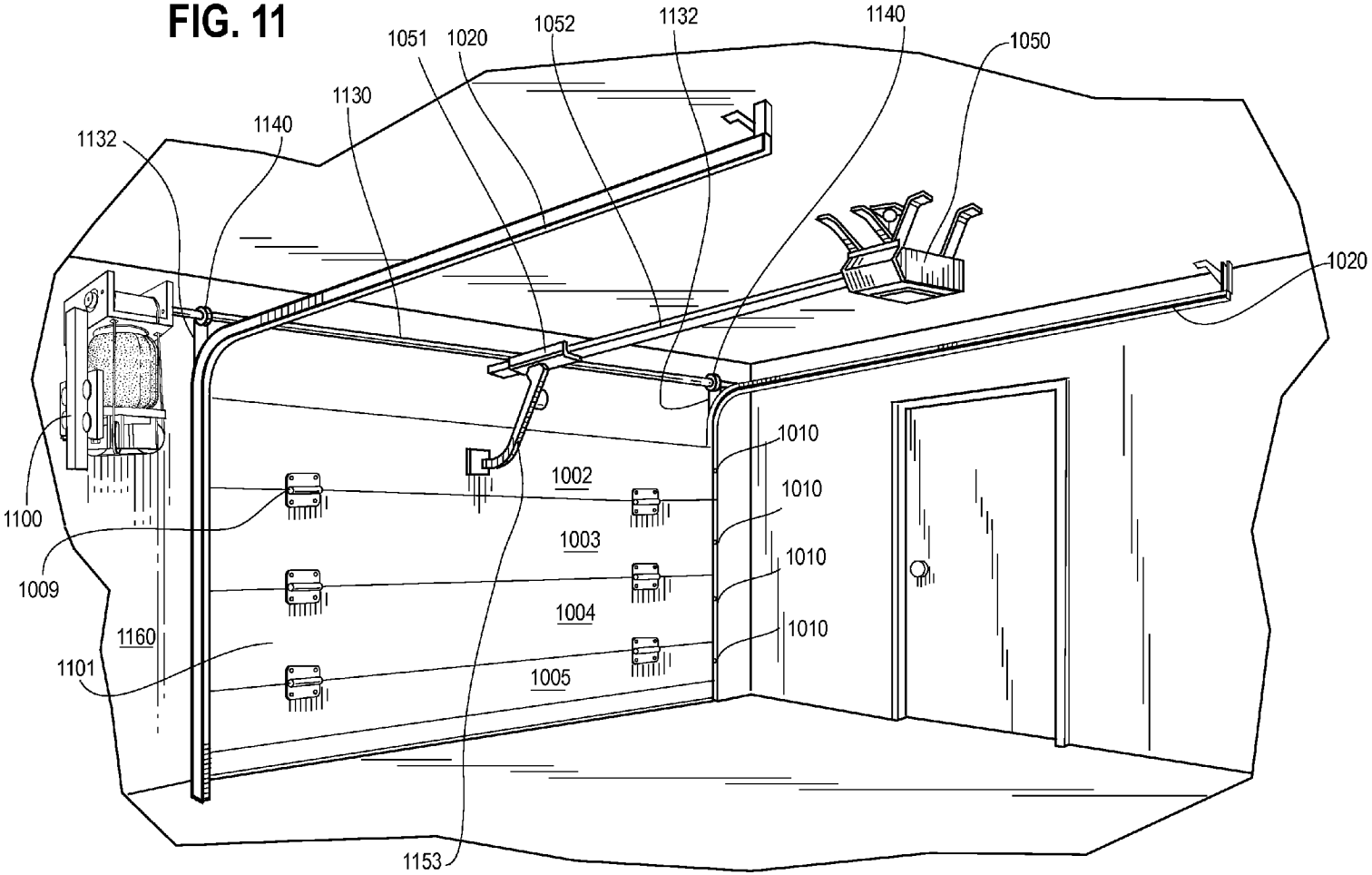
FIG. 11 comprises a perspective view illustrating installation of an example air spring counterbalance mechanism.

With brief reference to the example of FIG. 11, the shaft 180 is configured to be coupled to the motion of a movable barrier 1101 such that the shaft 180 rotates as the movable barrier 1101 is lowered and raised. In this arrangement, when the shaft 180 rotates in a first direction associated with lowering the movable barrier 1101, it causes the causes the drum 170 to take up the cable 150 and compress the air spring 110. Similarly, when the shaft 180 rotates in the opposite direction while opening the movable barrier 1101, it unspools the cable 150 from the drum 170 and allows the air spring 110 to relax. The planetary gear mechanism 171 serves to couple the drum 170 to the shaft 180 and to reduce the rotational speed of the drum 170 relative to the rotational speed of the shaft 180. In this way, the planetary gear 171 serves as a linkage mechanism between the drum 170 and a movable barrier. The fixed plate 120 includes a mounting bracket 121. The mounting bracket 121 includes through holes 122 such that the mounting bracket can be fixed to a garage wall (e.g., 1160 in FIG. 11).

Figure 3:
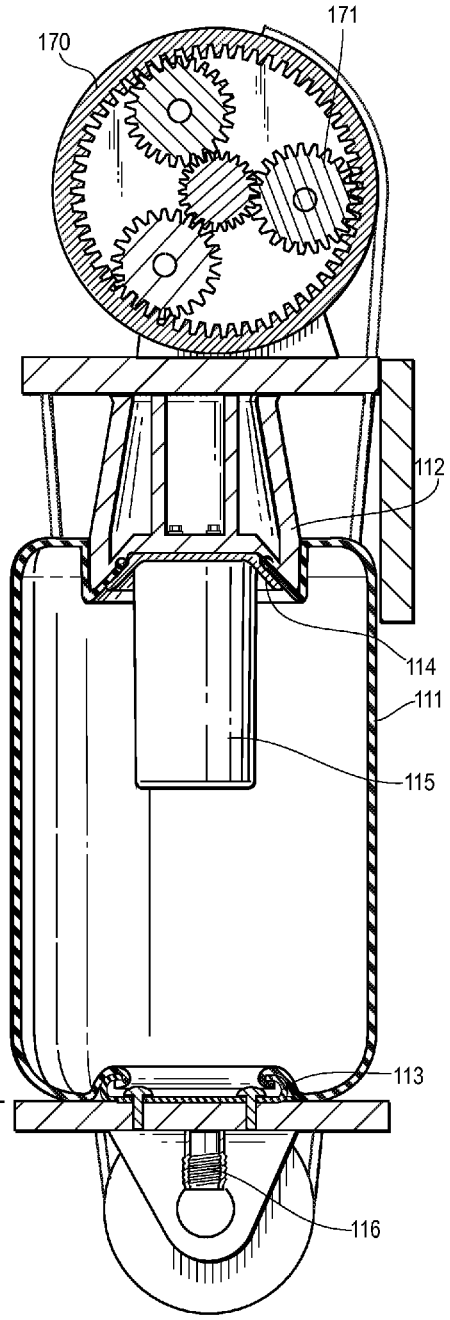
FIG. 3 comprises a cross-section side view of the air spring counterbalance mechanism of FIG. 1 along line 3-3.
Figure 4:
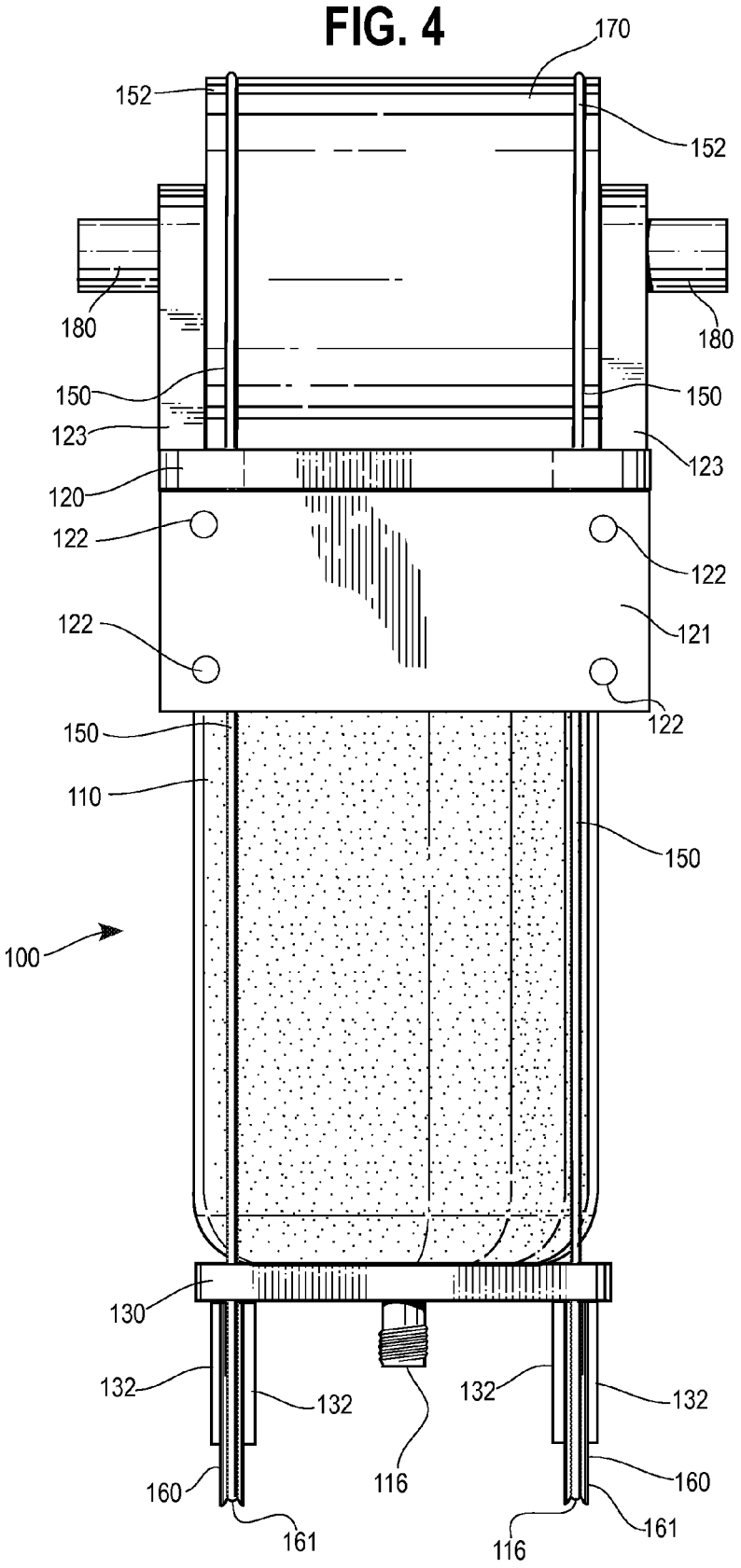
FIG. 4 comprises a front view of the air spring counterbalance mechanism of FIG. 1.

With reference to FIG. 3, a cut-away view that illustrates the inner workings of the example air spring 110 will be described. Section lines appear on FIG. 1 to illustrate the nature of the cut-away illustrated in FIG. 3. Air springs have been known in the art relating to vehicle suspension systems since the 1930's. In one approach, a flexible fluid-based spring includes a rubberized bladder in a substantially cylindrical configuration disposed between two surfaces, wherein the bladder is configured to receive and contain a fluid, such as gas or air. An example air spring suitable for use in various applications described herein is a GOODYEAR® air spring, model number 1S4-008. Air springs typically consist of an air-tight flexible member 111 fixed between a bead plate 113 and a piston 112. The end closure 114 is molded to the flexible member to form an air-tight seal at one end of the flexible member 111. At the other end, the flexible member 111 is crimped to the bead plate 113 to form an air-tight seal. As the piston 112 is displaced toward the bead plate 113, the piston 112 drives into the volume of air contained in the flexible member 111, causing that volume to reduce and therefore compressing the air inside the flexible member 111. Thus, an increasing force is required to displace the piston 112 further towards the bead plate 113, in much the same way a mechanical coil spring requires increasing force to accomplish greater displacement. In some air springs, a bumper 115 is included to provide a stop that prevents the piston 112 from contacting the bead plate 113. This description of a typical air spring is merely exemplary and not intended to limit the types of air spring used in the disclosed approaches. In addition, although air is discussed herein, any compressible fluid could be used to fill the flexible member 111. For example, a variety of pure or mixed gases could be used instead of air.

The use of the air spring 110 in this mechanism provides several benefits over a traditional coil spring. The force generated by the air spring 110 at a given displacement is capable of adjustment by increasing or reducing the air pressure within the air spring 110. A nozzle 116 allows air to be added or removed from the air spring 110 to adjust air spring's 110 internal air pressure. The nozzle 116 preferably incorporates a one-way valve or other mechanism to capture the air pressure added to the air spring 110. Because the air spring's 110 internal air pressure correlates to its output force, the air spring counterbalance mechanism 100 can be adjusted simply by adjusting the air spring's 110 air pressure to accommodate many different sizes and weights of movable barrier. Thus, a single air spring counterbalance mechanism 100 can serve to replace multiple mechanical springs. Instead of stocking an inventory of different torsion springs for different door-weights, a single air spring mechanism can be installed and then adjusted to accommodate a given movable barrier.

Another benefit of the air spring, as compared to traditional coil springs, is the reduced likelihood of a sudden failure in the counterbalance mechanism. Mechanical springs have a tendency to fail suddenly and with little warning. In contrast, air springs are most likely to fail gradually, typically through loss of pressure over time due to a gradual leak. This provides ample warning of the imminent failure. When complete failure occurs, the spring gradually goes limp rather than suddenly and uncontrollably releasing energy. In addition, air springs are known to have substantially longer cycling lifespans than the mechanical torsion springs commonly used in movable barrier counterbalance mechanisms.

Figure 5:
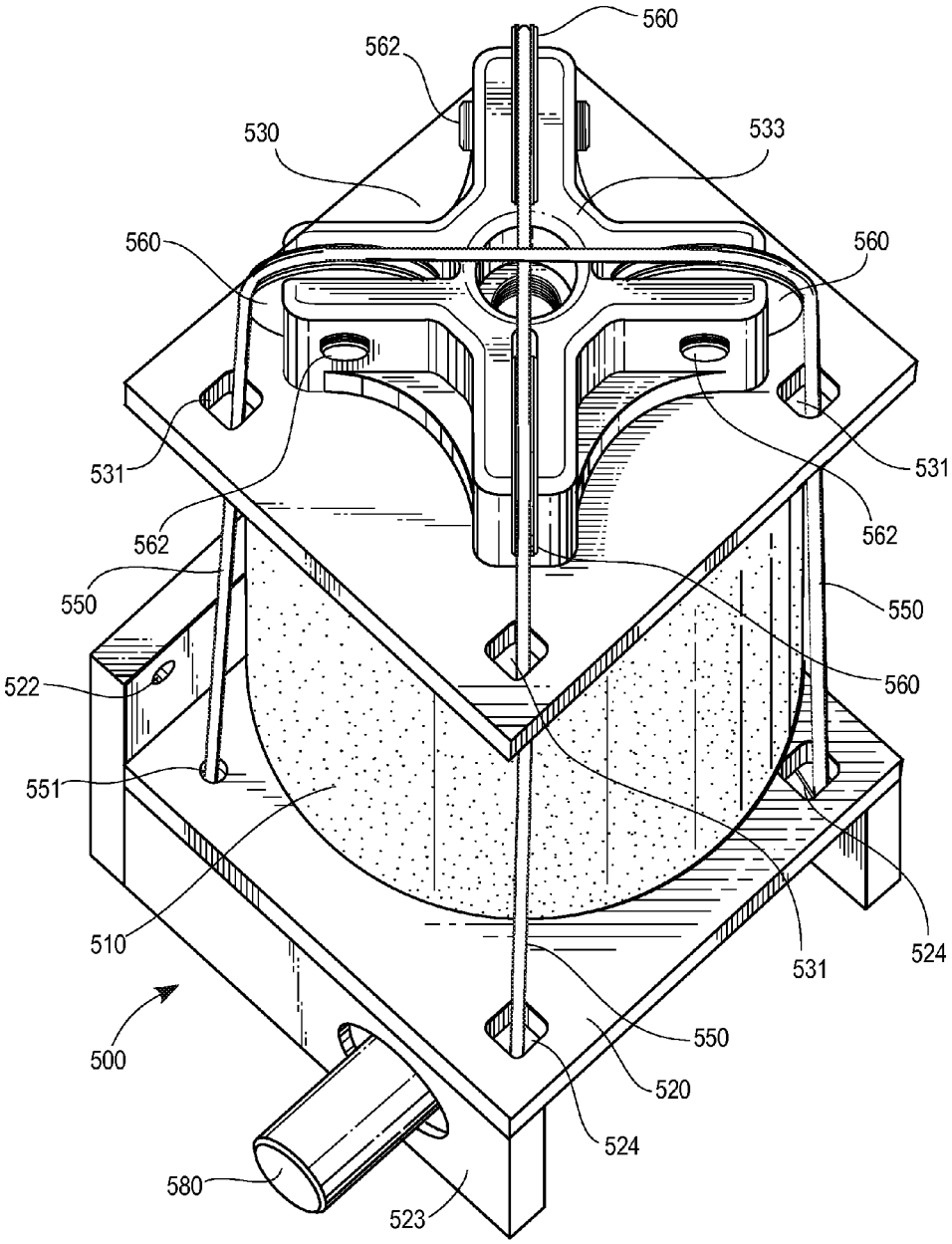
FIG. 5 comprises a perspective view of the bottom of an example air spring counterbalance mechanism.

FIG. 5 is a bottom perspective view that illustrates an alternative approach of the air spring counterbalance mechanism 500, in which cables 550 are routed in a cross-wise fashion over four pulleys 560 mounted on the bottom of the movable plate 530. Each cable passes over two pulleys 560. This approach serves to balance the load on the cables 550 and reduces the overall weight supported by each pulley 560.

The air spring 510 is mounted between a fixed plate 520 and a movable plate 530. The cables 550 are fixed at a first end 551 to the fixed upper surface and route through holes 531 in the movable plate 530. The cables pass over pulleys 560 and through a second set of holes 531 in the movable plate 530. The pulleys 560 rotate on shafts 562 that are supported by a housing 533 that extends from the bottom surface of the movable plate 530. The cables 550 then route through holes 524 in the fixed plate 520 and are mounted to a drum (570 shown in FIG. 8). The drum is mounted to a rotatable shaft 580 that is configured to interface with a jack shaft (not shown). As the shaft 580 is rotated, the cable is spooled or unspooled from the drum 570, causing the air spring 510 to be compressed or released, respectively.

Other approaches of the translational mechanism are possible, as would be envisioned by a person having ordinary skill in the art. These might include, but would not be limited to, various methods of fixing the cable 550 to the plates 520 and 530, the use of multiple drums 570 to take up the cable 550, and designs in which the pulleys 560 are eliminated by fixing the cables 550 to the movable surface 530.

Figure 6:
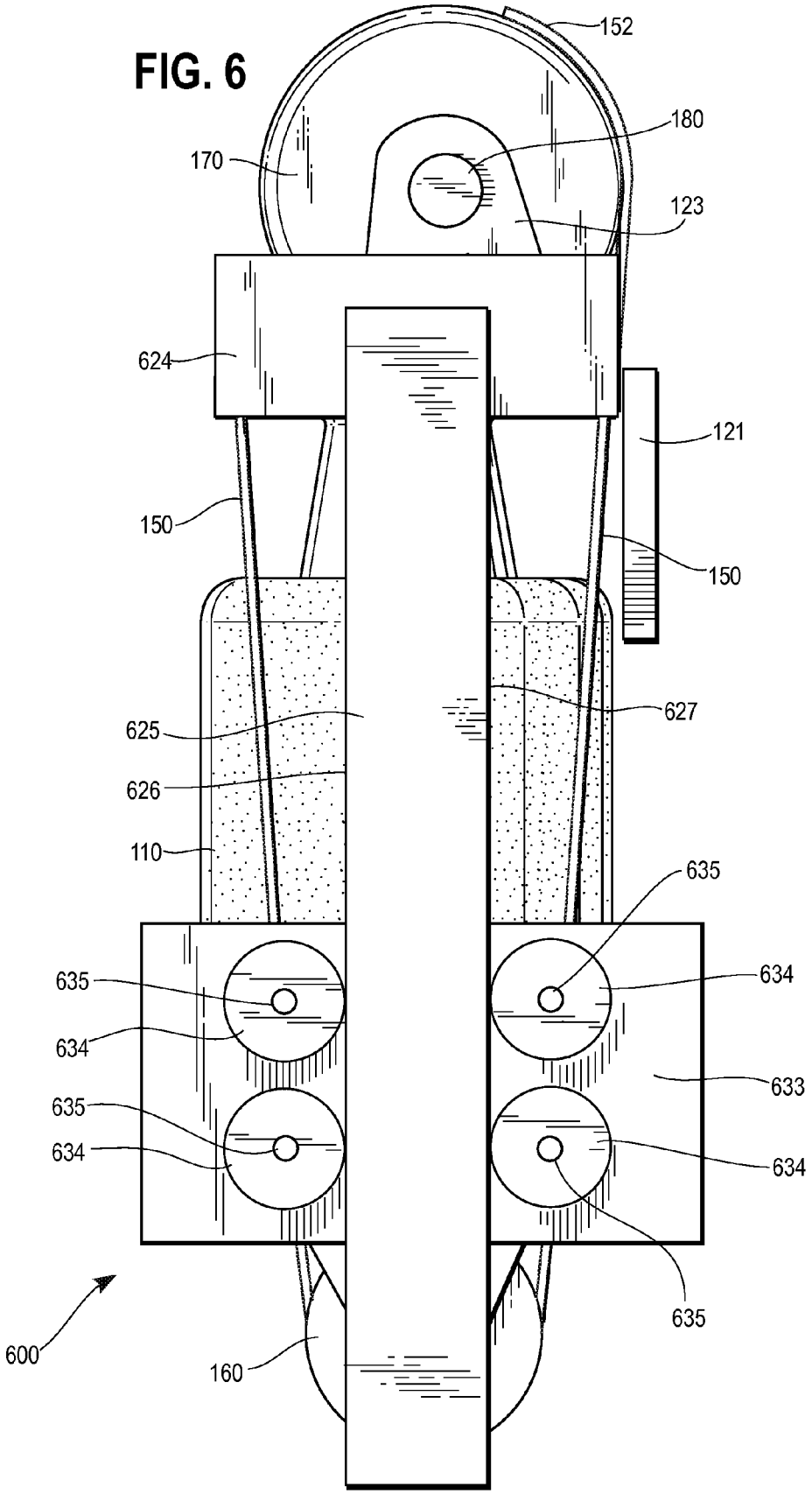
FIG. 6 comprises a side view of an example air spring counterbalance mechanism illustrating additional supporting structures.
Figure 7:
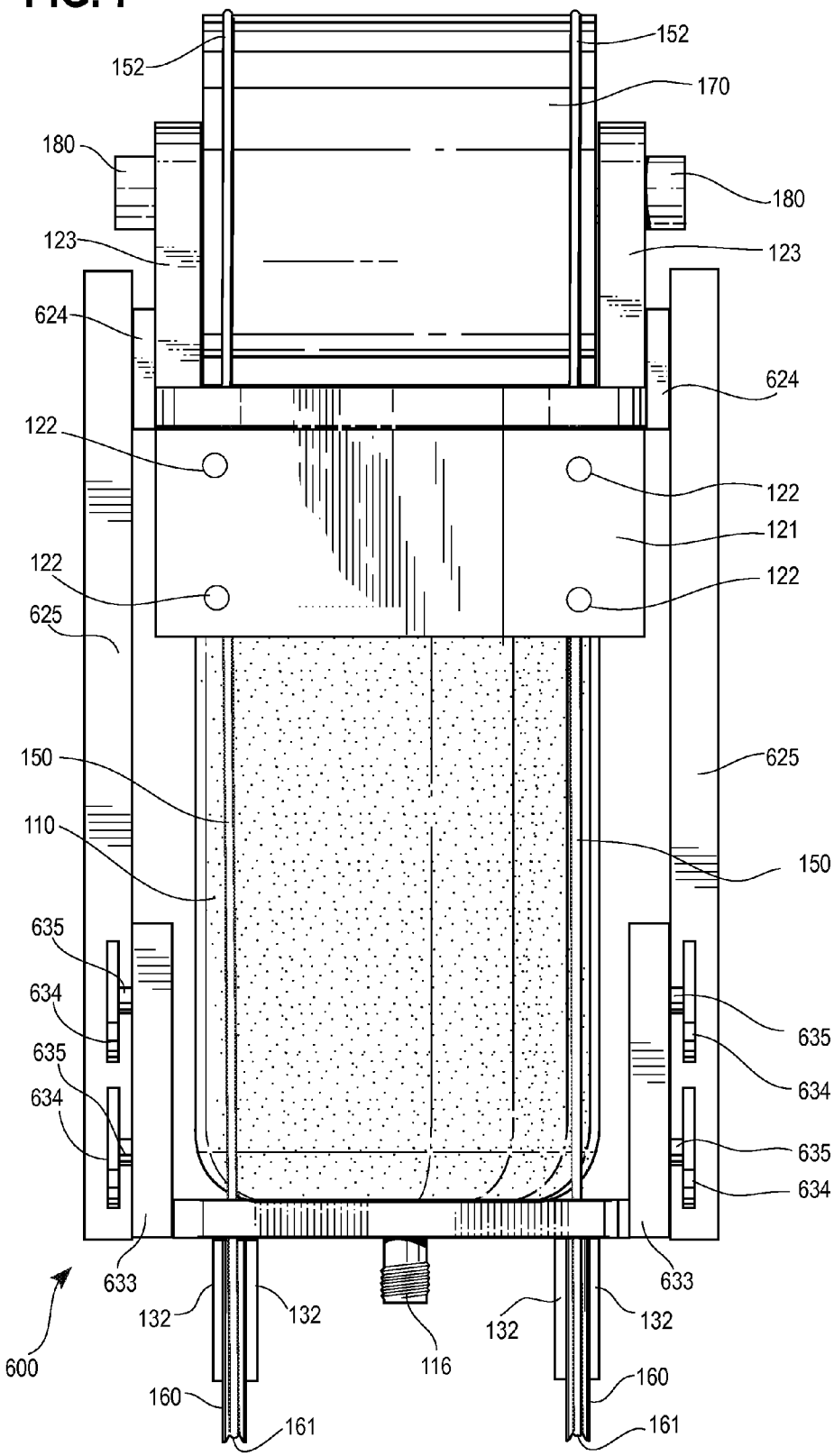
FIG. 7 comprises a front view of the air spring counterbalance mechanism of FIG. 6.

FIGS. 6 and 7 illustrate an example counterbalance mechanism 600 with supporting structures provided to maintain the correct orientation of the air spring 110. Except as described further here, the features of the mechanism 600 are the same as described with respect to FIGS. 1-4. Side plates 624 attach to either side of the fixed plate 120. A vertical stabilizer 625 is fixed to each side plate 624. The vertical stabilizers run parallel to the air spring 110. Each vertical stabilizer has a first surface 626 and a second surface 627 that are parallel to one another.

Bottom side plates 633 extend vertically from the movable plate 630. Four guide rollers 634 are mounted on each of the bottom side plates 633. The guide rollers 634 are supported by shafts 635 that extend outwardly from the bottom side plates 633. The rollers 634 are mounted such that they bear against the vertical stabilizers 625. In this way, the rollers 634 and the vertical stabilizers 625 keep the movable plate 130 substantially parallel to the fixed plate 120.

Figure 8:
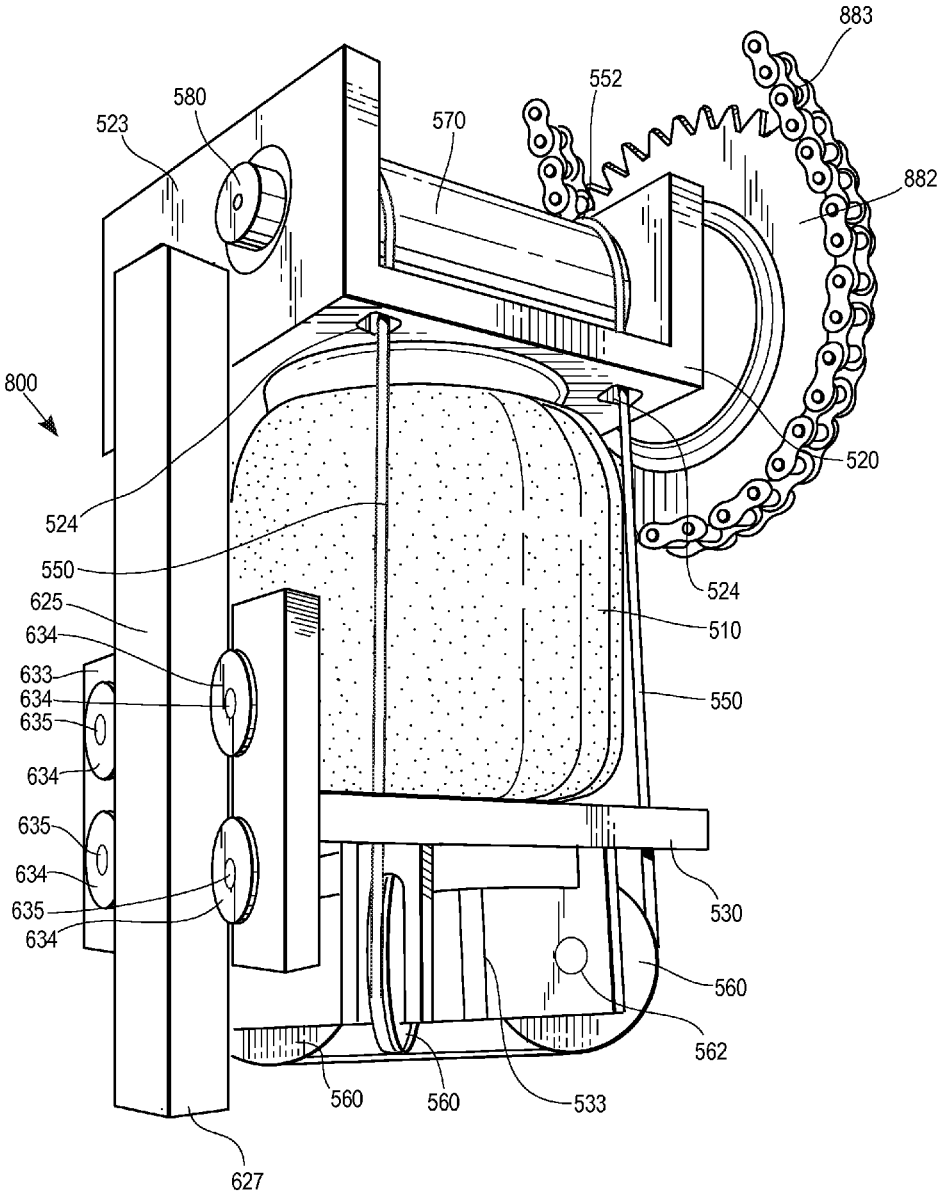
FIG. 8 comprises a perspective view of another example air spring counterbalance mechanism.

FIG. 8 further illustrates the example supporting structures described with respect to FIGS. 6 and 7. A counterbalance mechanism 800 contains features previously described with respect to FIG. 5, specifically including pulleys 560 mounted such that the cables 550 are routed below the movable surface 530 in a cross-wise fashion. Instead of a planetary gear mechanism (e.g., 171 of FIG. 1), the counterbalance mechanism 800 has a gear 882 mounted to the rotatable shaft 580. A chain 883 drives the gear 882. This approach is discussed in more detail below with respect to FIG. 9. In this example, the drum 570 is directly mounted to the rotatable shaft 580.

As discussed with respect to FIGS. 6 and 7, the vertical stabilizer 625 provides surfaces 626 and 627 against which the rollers 634 bear. The rollers 634 constrain the movable plate 530 to a position that is substantially parallel to the fixed plate 520, even as the cables 550 compress the air spring 510. The support structures, including the vertical stabilizer 625, bottom side plates 633, rollers 634, and other ancillary components illustrated on the left hand side of FIG. 8, could also be duplicated on the right hand side of the mechanism 800 although they are not depicted in FIG. 8.

Figure 9:
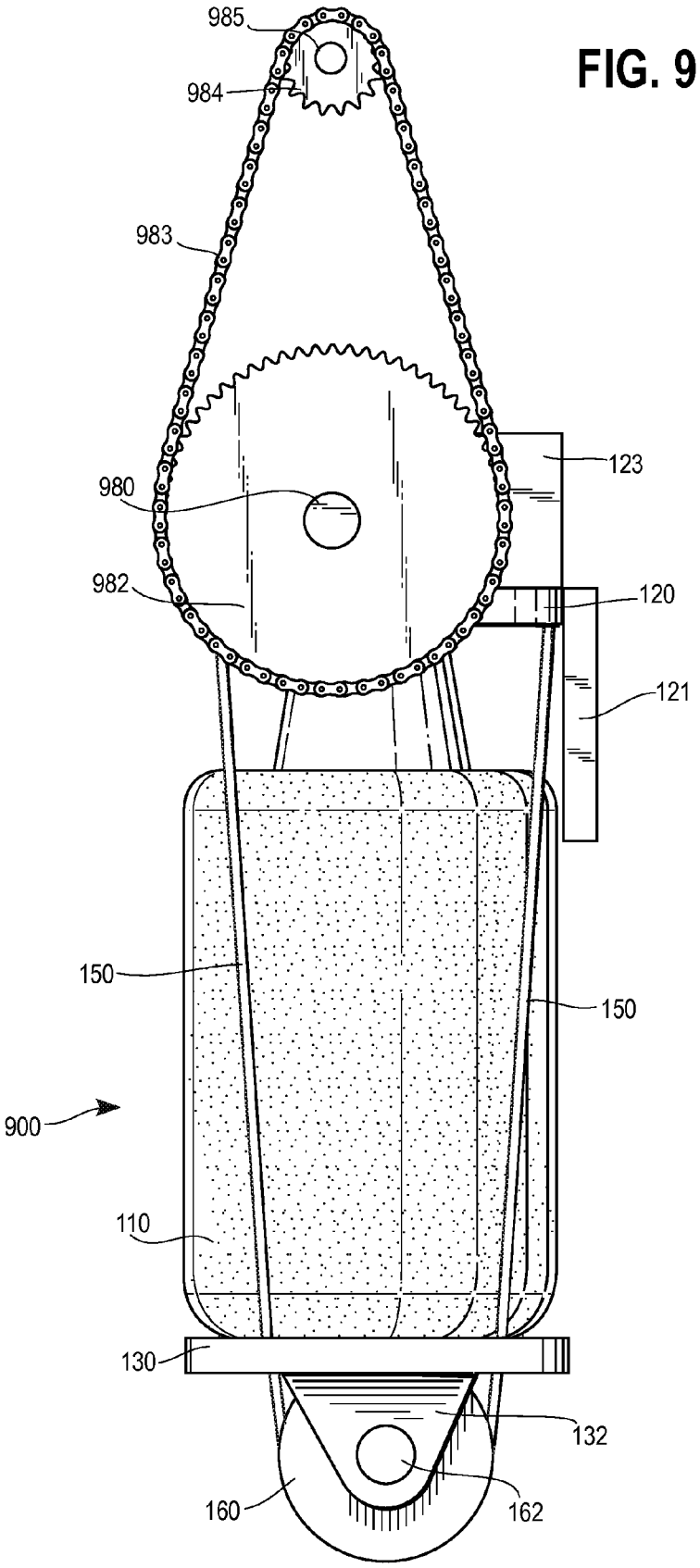
FIG. 9 comprises a side view of another example air spring counterbalance mechanism.

FIG. 9 illustrates a chain-driven alternative approach to a fluid-based counterbalance system 900 having the linkage mechanism to the movable barrier including a first shaft and a second shaft operatively coupled to the first shaft through at least one gear. A sprocket 984 is mounted to the jackshaft 985. The jackshaft 985 is coupled to a movable barrier (e.g., 1101 in FIG. 11), such that the jackshaft 985 rotates as the movable barrier is raised or lowered. A chain 983 couples the sprocket 984 to a gear 982. The gear 982 is coupled to the drum (e.g., 870 in FIG. 8) such that the drum rotates and takes up the cable 950 as the movable barrier is lowered. In this approach, the sprocket 984 and gear 982 serve to reduce the rotation of the drum relative to the rotation of the shaft 985. Other approaches to designing the linkage mechanism are possible, as would be envisioned by a person having ordinary skill in the art. These would include any gear, chain, belt, or other similar mechanism. The remaining features illustrated in FIG. 9 are substantially the same as have been described with respect to FIGS. 1-4, above.

Figure 10:
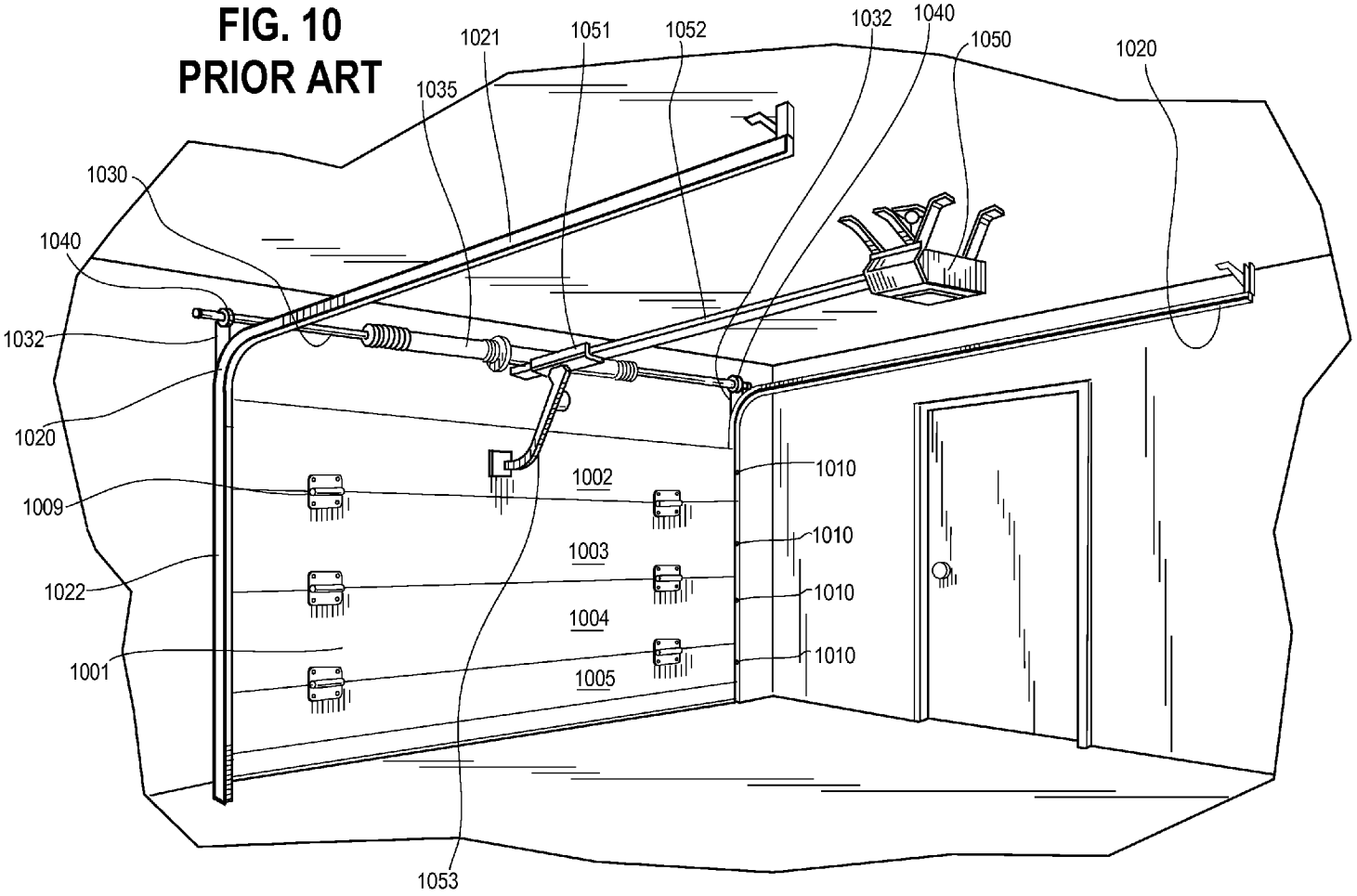
FIG. 10 PRIOR ART
FIG. 10 comprises a perspective view illustrating installation of a prior art device.

Turning to FIG. 11, an example interface between the air spring counterbalance and a common movable barrier configuration will be discussed. The air spring counterbalance 1100 interfaces with the jack shaft 1130 of a garage door 1101. Any movable barrier may be counterbalanced by the air spring counterbalance 1100, including a single panel or segmented garage door, a rolling shutter or other barrier that may be opened and closed by lifting the movable barrier against the force of gravity. The garage door 1101 includes features of the garage door 1001, depicted in FIG. 10, including panels 1002, 1003, 1004, 1005, hinges 1009, and rollers 1010, which run along tracks 1020. The drums 1140 are fixed on either end of the jackshaft 1130. In some installations the drums 1140 are placed at intermediate locations along the jack shaft 1130. As described with respect to FIG. 10, the drums 1140 rotate with the jackshaft 1130 and take up cables 1132 that run from the drum to at the base of the door 1101. In this system, when the jackshaft 1130 rotates in a first direction, it raises the garage door 1101 by spooling up the cables. If the jackshaft 1130 rotates in the opposite direction, the garage door 1101 lowers as the cables 1132 are unspooled from the drums 1140. In addition to being coupled to the jackshaft 1130, the air spring counterbalance mechanism 1100 is rotatably fixed. A bracket plate (e.g., 121 in FIG. 1) located at the fixed end of the air spring counterbalance is affixed to the wall 1160 using screws or bolts. A person of ordinary skill in the art will recognize that many other means may be appropriate for affixing the counterbalance mechanism 1100 to the wall 1160.

The air spring counter balance 1100 is intended to replace other counterbalancing mechanisms such as the mechanical torsion spring (e.g., 1035 in FIG. 10) frequently used to counterbalance the weight of a garage door 1101, although in one approach the counter balance 1100 could also serve as a supplement to these other counterbalancing mechanisms. In another approach, the air spring counter balance 1100 may be installed on the opposite end of the jackshaft 1130. In still another approach, one or more air spring counter balances 1100 are installed at either or both ends of the jackshaft 1130, for example, to compensate for heavy or wide garage doors. In yet another approach, the air spring counterbalance 1100 includes adaptations that allow more than one air spring counterbalance to couple together in series. The rotatable shafts (e.g., 180 in FIG. 1) of the respective air spring counterbalance mechanisms are coupled together via a coupling device to accommodate series installation. In this way, counterbalance mechanisms may be added modularly to accommodate a variety of movable barriers, based on the weight, size, or orientation of the barrier.

The design of the air spring counterbalance mechanism is advantageous over the mechanical torsion springs that are typically used as movable barrier counterbalance mechanisms. Because the air spring counterbalance mechanism can be installed at the end of the jackshaft, the jackshaft does not need to be disassembled and removed when the air spring counterbalance mechanism is installed or replaced. This reduces the time and labor required to install or replace the air spring counterbalance mechanism, which is a benefit to any owner of a movable barrier system. The reduction in time and labor is a particular benefit for owners of commercial and industrial movable barriers, which are subject to more frequent use and consequently more frequent replacement.

Figure 12:
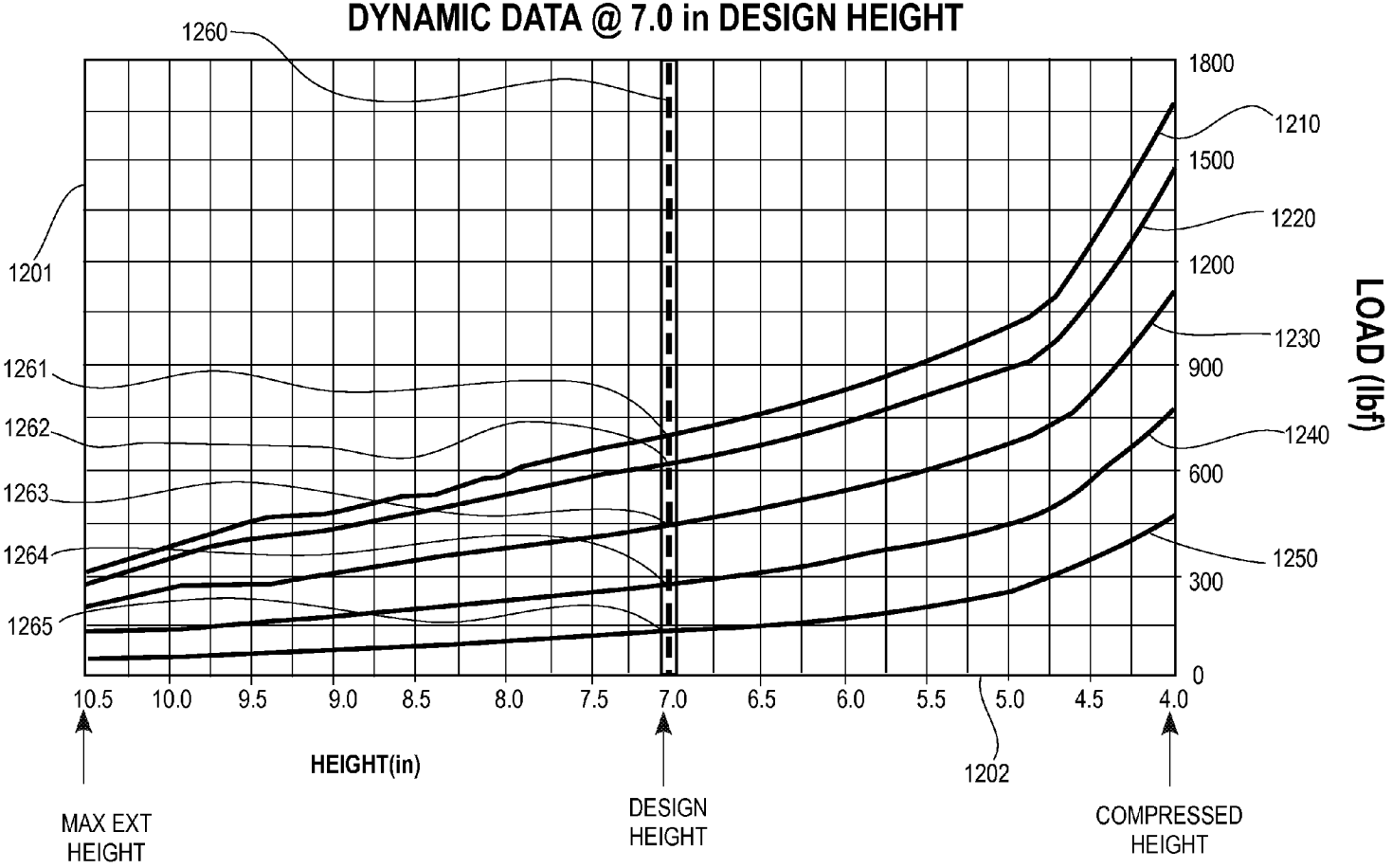
FIG. 12 comprises several plots showing forces exerted by a typical air spring over a range of displacements of the air spring.

The relationship between displacement, force, and pressure within the Goodyear® 1S4-008 air spring is plotted in FIG. 12. The chart 1200 shows the force exerted by the air spring on the y-axis 1201, and the height of the air spring on the x-axis 1202. One of skill in the art understands "height" of the air spring to mean the distance between compression ends of the air spring. For example, in the air spring illustrated in FIG. 3, the height is the distance H between the top of the movable plate 130 and the bottom surface of the fixed plate 120. The "height" of the air spring changes with the physical compression of the air spring. The plot lines 1210, 1220, 1230, 1240, and 1250 show the force exerted by the air spring at a given displacement, for different initial fluid pressures. For example, the plot line 1250 indicates the load on the spring assuming 21 psig of air pressure is applied before the spring is compressed. Although 21 psig is the starting air pressure, the air pressure within the air spring will increase as the spring is compressed, requiring an increasing force to further displace the spring. The plot line 1240 illustrates a force-displacement curve for an initial pressure of 39 psig, and lines 1230, 1220, and 1210 illustrate curves respectively associated with 60 psig, 82 psig, and 92 psig. By changing the fluid pressure within the air spring, the characteristics of the spring can be manipulated, as illustrated by the plot lines 1210, 1220, 1230, 1240, and 1250. The dashed line 1260 represents the initial height of the air spring. The intersections of the dashed line and the various plot lines 1220, 1230, 1240, and 1250 are labeled, respectively, as 1261, 1262, 1263, 1264, and 1265. The effect of changing the air pressure is well illustrated by looking at the intersections 1261 and 1263, which show that reducing the air pressure from 92 psig to 60 psig reduces the force exerted by the spring from approximately 700 lbf (pounds of force) to 425 lbf.

The variable force exerted by an air spring is one advantage associated with various ones of the described designs. By adjusting the fluid pressure in the air spring, the air spring counterbalance can be adjusted to match the force needed to balance the weight of the movable barrier, which offers several benefits. Because the force exerted by the air spring counterbalance mechanism corresponds to the pressure of the air in the air spring, the counterbalance mechanism can be installed in a de-energized state and later pre-loaded by pressurizing the air spring, reducing the level of skill and training required to install the counterbalance device. In contrast, mechanical torsion springs must be pre-loaded before they are secured, or as part of the process of securing the spring. If the mechanical spring is improperly secured after pre-loading, the spring may snap loose suddenly and release its stored energy.

Further, as illustrated in FIG. 12, changing the initial pressure within an air spring changes the slope of the plot lines. This slope corresponds to the spring rate, in pounds per inch (lb./in.), of the air spring. Spring rate is a design characteristic that must be selected when choosing mechanical springs, however an air spring allows the spring rate to be adjusted based on the unique needs of any particular installation.

Figure 13:
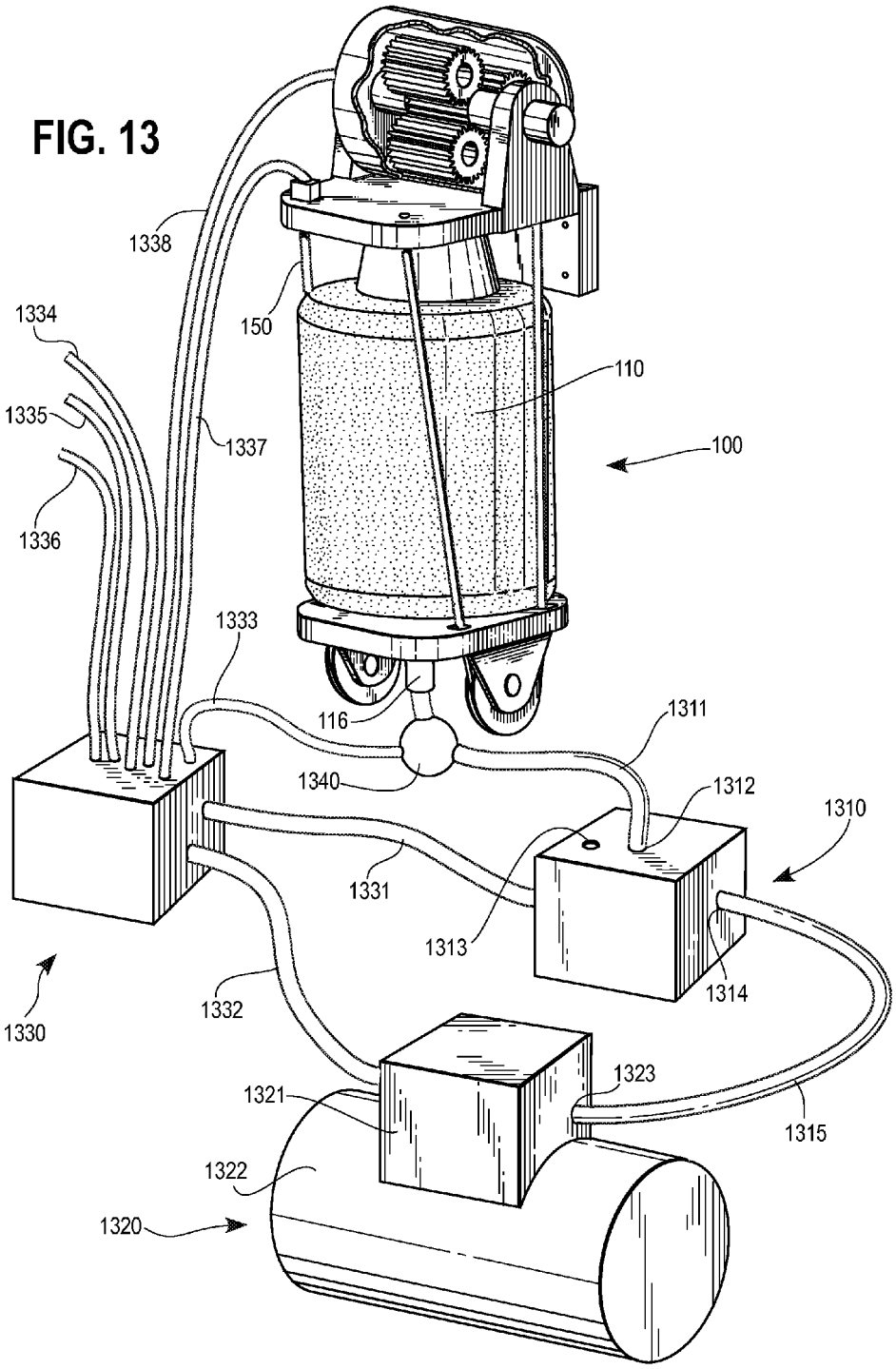
FIG. 13 comprises a conceptual illustration of an example control system for an air spring counterbalance.

Additionally, by varying the pressure within the air spring, the air spring counterbalance can be used to move a garage door (e.g., 1101 depicted in FIG. 11). FIG. 13 is a conceptual view of an air spring counterbalance and an exemplary control system used to vary the fluid pressure within the air spring of the counterbalance. The physical embodiments of this system might be incorporated in a single unit or distributed among separate elements, as shown. A valve 1310 controls air flow through a hose 1311 connected to the flexible fluid-based spring, here an air spring, via the connector valve 116. The valve 1310 includes an outlet port 1312, an exhaust port 1313, and an inlet port 1314. Preferably, the valve 1310 is a three position valve with an open state, an exhaust state, and a no-flow state. In another approach, the valve could be a two position valve with an open state and an exhaust state. A compressed air hose 1315 provides high pressure air from an air compressor 1320. The compressor 1320 includes a compressor unit 1321 and a pressure tank 1322. The compressed air hose 1315 attaches to the compressor at an outlet port 1323. One of skill in the art would recognize that the compressor 1320 can be replaced with any source of pressurized fluid or air.

Operating circuitry is configured to control a position of a movable barrier by effecting adding pressurized fluid to the flexible fluid-based spring from the source of pressurized fluid coupled to the flexible fluid-based spring or by effecting removal of pressurized fluid from the spring via a release mechanism operably controlled by the operating circuitry. In the illustrated example, the operating circuitry includes control electronics 1330 that provide signals to the valve 1310 and the compressor 1320 to control the operation of those devices. The valve control wire 1331 provides a signal that indicates to the valve 1310 to go to the open state, or the exhaust state, or to a no-flow state. In the open state, air is added to the air spring 110, and the pressure in the air spring is consequentially increased. In the exhaust state, air flows from the air spring 110 through the exhaust port 1313 of the valve 1310, reducing the pressure in the air spring 110. Preferably, the exhaust port 1313 includes a constriction that limits the amount of air exiting the air spring 110 to a controlled rate. In the no-flow state, the air spring 110 is closed off and maintains whatever pressure is already in the air spring 110. In one approach, the signal transmitted via the wire 1333 is a digital electronic signal (e.g. 12V, −12V, or 0V). Alternative approaches could include analog electronic signals or any communication signal known in the art. In one alternative approach, the valve 1310 is replaced with a pressure regulator, such that the electronic signal sent over the wire 1331 commands the regulator to maintain a certain pressure within the air spring 110. The compressor control wire 1332 provides a signal that indicates to the compressor 1320 that the compressor should run. As with the signal sent to the valve 1310, a digital signal is preferred for control of the compressor 1320, but other signals could be used in alternative approaches. In still other approaches, the signal may indicate the desired pressure that the compressor 1320 should generate.

The control electronics 1330 also receive signals. A pressure gauge 1340 is mounted inline in the hose 1311 between the valve 1310 and the air spring counterbalance 100. The pressure gauge 1340 provides a signal via a pressure signal wire 1333, so that the control electronics 1330 knows what pressure exists within the air spring counterbalance 100. In other approaches, a wire 1337 connected to a strain gauge on the cable 150 might provide information about the force exerted by the air spring counterbalance. Similarly, a wire 1338 connected to a torque sensor mounted to the shaft 180 might indicate the output torque generated by the air spring counterbalance. The control electronics 1330 receive command signals, either through electro-magnetic radiation such as radio or light-based signals or through a wired connection 1334 to a command button. Door position sensors provide position information for the garage door 1101 to the control electronics 1330 via wires 1335 and 1336. The door position sensors may alternatively be proximity sensors or digital encoders, and additional wires may be added to the system to accommodate these different sensors. In alternative approaches, any of the signals received by the control electronics 1330 could be received via a wireless communications protocol.

The control electronics comprises a processor capable of receiving command signals and pressure signals. The processor is also capable of acting upon those signals based on predetermined logic and providing output signals to the valve and the compressor such that those devices modulate the pressure in the air spring and therefore operate the air spring to move a garage door (e.g., 1101 in FIG. 11). Upon receipt of a command signal, the control electronics 1330 evaluate the current position of the garage door according to signals received on the wires 1335 and 1336. The control electronics also evaluate the pressure, force, or torque within the air spring counterbalance 100 to determine how to command the valve 1310 and the compressor 1320. For example, the control electronics might detect that a high pressure already exists within the air spring 110, which indicates that the valve should be commanded to the exhaust state to release pressure from the air spring 110 and lower the garage door 1101. Alternative examples of the control electronics 1330 could comprise a processor located remotely from the control electronics, or would rely upon electronic circuits to provide the operating logic instead of a processor.

Figure 14:
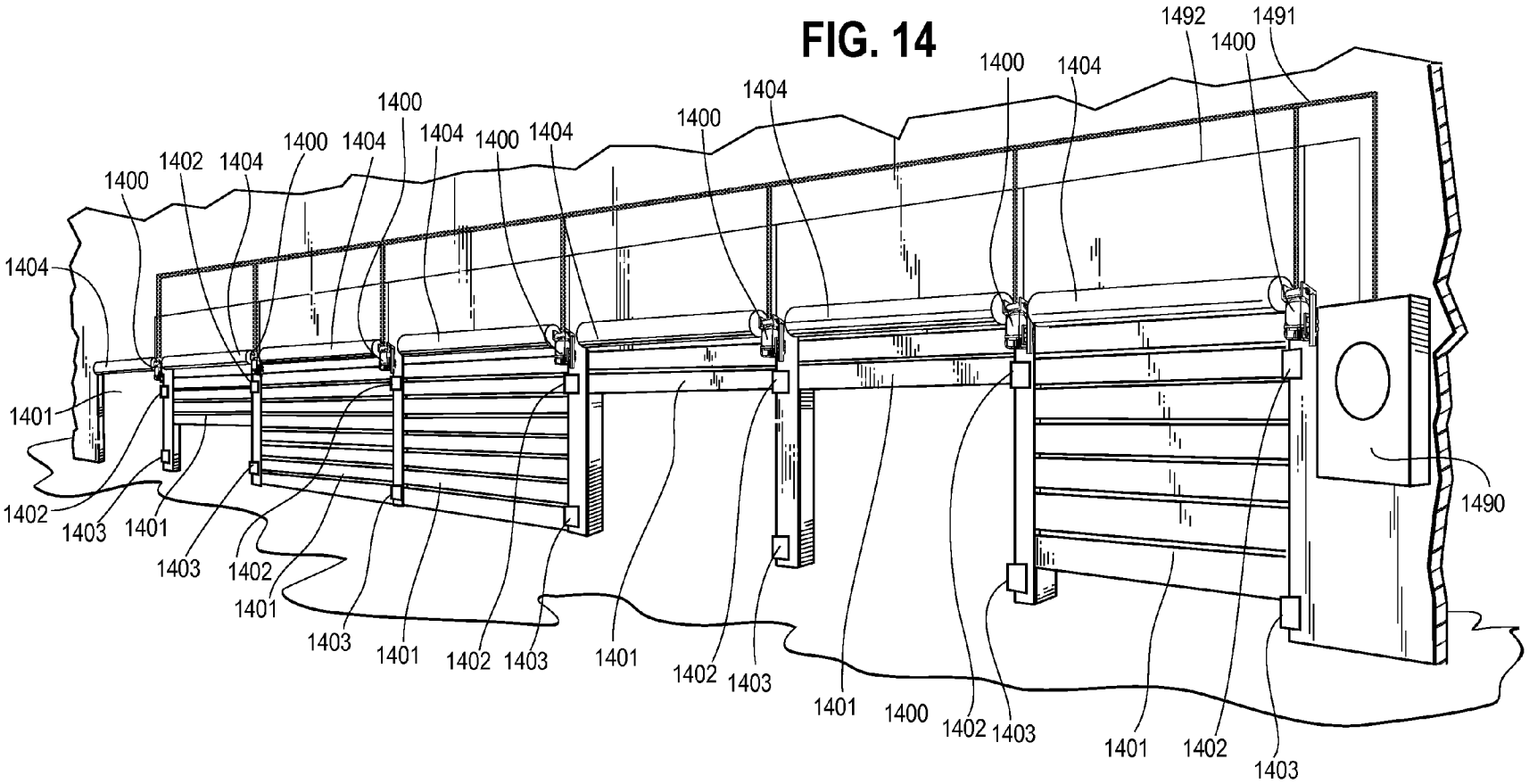
FIG. 14 comprises a perspective view illustrating an example multi-door installation of air spring counterbalance mechanisms.

FIG. 14 illustrates an example multi-door installation in which an air spring counterbalance mechanism 1400 is installed on each of the doors 1401. Each air spring counterbalance mechanism 1400 is connected to a source of pressurized fluid. An air compressor and central control unit 1490 provides pressurized air to each counterbalance mechanism 1400. Preferably, a central air compressor provides a ready source of compressed air. By varying the air pressure in the counterbalance mechanisms 1400, the mechanisms can serve not only to counter the weight of the doors 1401 but also as operators to raise or lower the doors 1401. When used in this fashion as an operator, the pressure of the air spring counterbalance preferably falls within the range of operating pressures produced by common industrial air compressors. Typically, industrial air compressors are known to provide up to 175 psig (pounds per square inch gauge). Alternatively, a dedicated compressor 1490 may be provided for use with each air spring counterbalance mechanism, as illustrated in FIG. 13. In this example, the air spring operating pressure may be higher according to the capabilities of the dedicated compressor.

Each of the counterbalance mechanisms 1400 is connected to a low voltage control line 1492 and a compressed air line 1491. The low voltage control line 1492 may comprise wiring for digital or analog signals, or any wired communication known to a person having skill in the art. Wireless communications are also possible. Each counterbalance mechanism 1400 has a valve (e.g., 1310 depicted in FIG. 13) and control electronics (e.g., 1330 depicted in FIG. 13). In this example, the control module 1490 receives signals including a command to operate any one of the movable barriers 1400. Based on the signals, the control module 1490 sends command signals via the low voltage control line 1492 to the control electronics at the proper counterbalance mechanism 1400. The control electronics open the barrier by opening the valve to allow compressed air into the air spring counterbalance mechanism 1400, from the compressed air line 1491. To close the barrier, the control electronics control the value to open the interior of the air spring to a lower pressure line or to the outside to lower the pressure of the air spring counterbalance mechanism. With the lower internal pressure, the barrier's weight causes the barrier to close.

Each counterbalance mechanism 1400 has position sensors 1402 and 1403 capable of determining the position of the door. Position sensors 1402 and 1403 may include proximity sensors, light beams, encoders or any other sensors known to a person having ordinary skill in the art. In one approach, the low voltage control line 1492 transmits signals to the control unit 1490 from the sensors 1402 and 1403 located at the counterbalance mechanisms 1400. In another approach, the sensors 1402 and 1403 are configured to send signals to the control electronics for the corresponding counterbalance mechanism, which can control the movement of the barrier at least in part in response to the signals from the sensors 1402 and 1403. In another approach, the counterbalance mechanism 1400 may include an encoder or other sensor designed to determine the position of the drum 1404.

Figure 15:
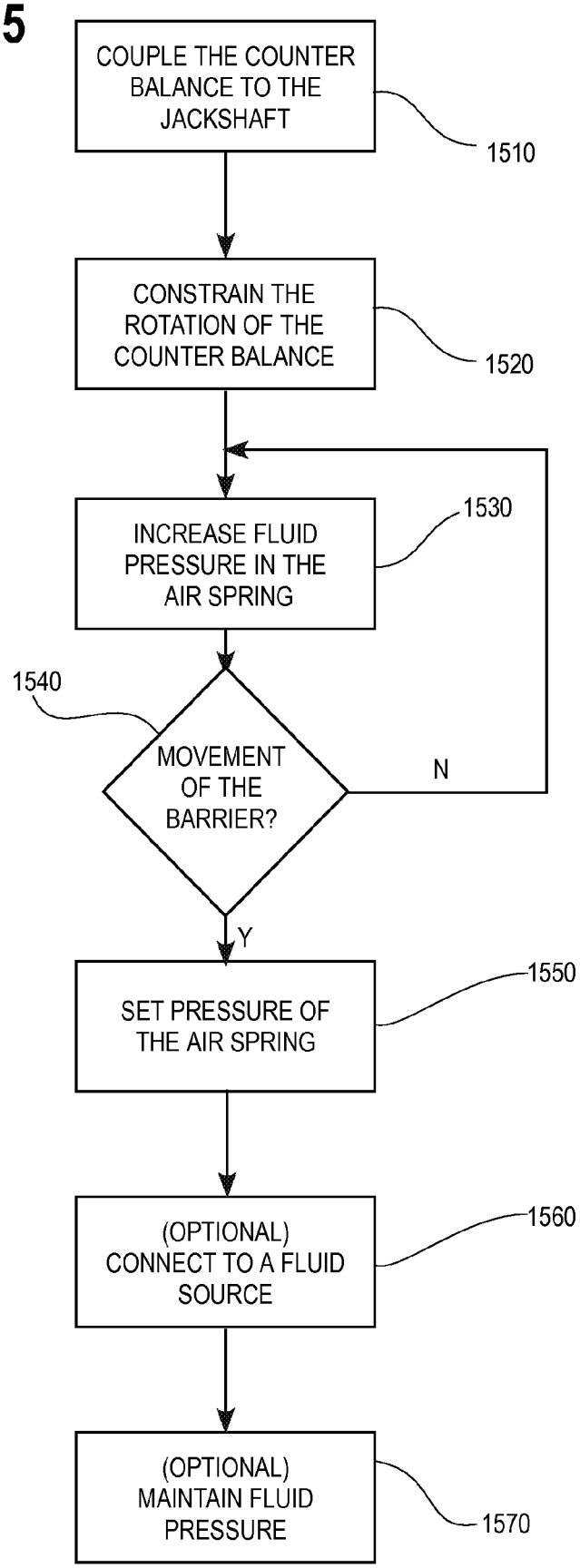
FIG. 15 comprises a flow chart illustrating an example method for installing an air spring counterbalance mechanism.

FIG. 15 describes a method for installing an air spring counterbalance in which the adjustment of air pressure in the air spring is used to accommodate a variety of movable barriers based on the weight, size, or orientation of the barrier. In steps 1510 and 1520, the air spring counterbalance mechanism (e.g., 1100) is coupled to the jackshaft (e.g., 1130) and affixed to the wall (e.g., 1160) or other support structure as described above. In step 1530, the pressure in the air spring is increased by adding air to the air spring (e.g., 110) via a connector valve (e.g., 116). Air may be added in discrete quantities or continuously. As described with reference to FIG. 12, the force exerted by the air spring increases as the pressure in the air spring increases. This force offsets the weight of the movable barrier, which reduces the effort required for a person or an automated barrier operator to move the barrier. According to step 1540, air is added until the barrier moves. Movement of the barrier indicates that the weight of the barrier has been fully offset by the force exerted by the air spring. In step 1550, the final air pressure is set by allowing a fixed volume of air to escape from the air spring, by observing a predetermined reduction of the air pressure in the air spring or by reducing the air pressure until the barrier returns to its prior position.

Optionally, as described in step 1560, the air spring is connected to a source of pressurized air. The pressurized air source may optionally be used at step 1570 to maintain the pressure in the air spring. This is accomplished by periodically adding a volume of air to the air spring, by using a pressure regulated valve to maintain a constant pressure in the air spring or by adding pressure or volume based on ambient temperature or the observed position of the door. The pressure source should be configured in step 1550, to the extent any of these mechanisms, or some other mechanism, is used to maintain the pressure in the air spring. These alternative approaches are implemented through hardware described with respect to FIG. 13. In one approach, the control electronics 1330 are configured to periodically open the valve 1310 to add pressure to the air spring 110. Alternatively, the control electronics 1330 are configured to maintain pressure within the air spring 110 by observing the input from the pressure gauge 1340 and opening the valve 1310 whenever the pressure in the air spring drops below a threshold set at step 1550. In yet another alternative, the control electronics 1330 comprise a temperature sensor and logic that causes the control electronics 1330 to add pressure to the air spring 110 in relation to the temperature at the air spring 110. As discussed with respect to FIG. 13, the control electronics 1330 receive position information from input wires 1335 and 1336. The control electronics 1330 may alternatively use the position information to determine the correct pressure for the air spring 110, and operate the valve 1310 to set that pressure.

In addition to setting the fluid pressure to counterbalance the weight of the movable barrier, the fluid pressure may be controlled dynamically to operate the movable barrier. By controlling the fluid pressure in the air spring, the barrier may be raised or lowered. In this mode of operation, the air spring counterbalance serves as both a counter balance mechanism and as a movable barrier operator. This system offers many advantages because it replaces both the movable barrier operator (e.g., 1050 in FIG. 10) and the counterbalance mechanism (e.g., 1035 in FIG. 10) currently used.

Figure 16:
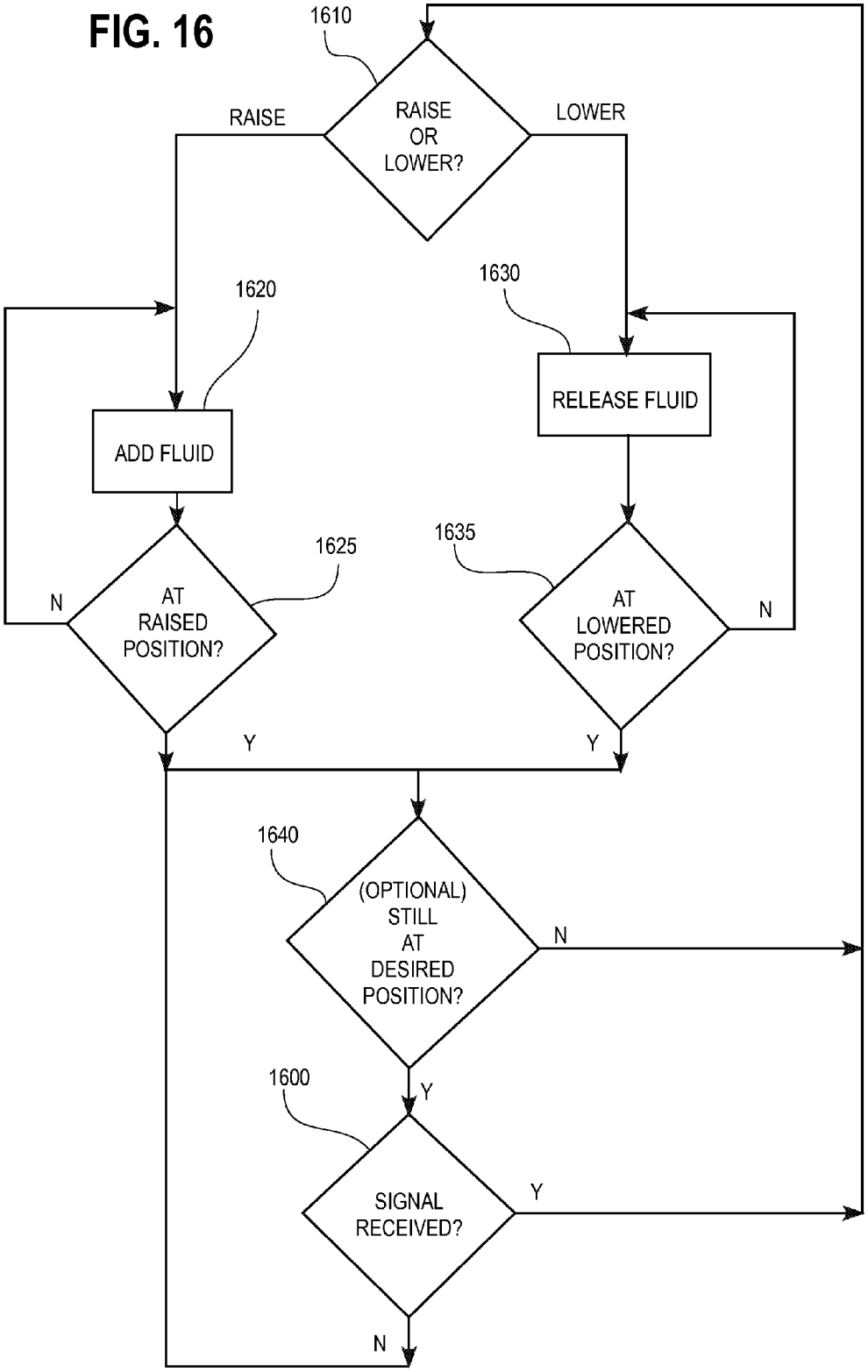
FIG. 16 comprises a flow chart illustrating an example method for using an air spring counterbalance mechanism to control the position of a movable barrier.

FIG. 16 describes a method for operating a movable barrier, using the air spring counterbalance mechanism. Starting from step 1600, control electronics (e.g., 1330 described in FIG. 13) evaluate whether they have received a command signal that indicates the barrier should be moved. If the signal is received, the system proceeds to step 1610 where it evaluates whether the door should be raised or lowered. In one alternative, the command signal simply indicates that the barrier should be moved without indicating what direction. In this alternative, the control electronics 1330 determine the present state of the barrier either by evaluating position sensor inputs 1335 and 1336, by evaluating a state stored in memory, or by testing movement in one direction to determine if movement in that direction is possible. In another alternative, the command signal itself indicates which direction the door should move and the control electronics proceed according to that command.

If the control electronics 1330 determines that the barrier is to be raised, the system proceeds to step 1620 and fluid is added to the air spring, by opening the valve 1310 discussed in FIG. 13. Fluid can either be added continuously or in discrete increments, by identifying a target pressure or by opening an input valve for a predetermined period of time. The amount of fluid to be added may be predetermined, for instance by using a learning system that identifies how much fluid must be added or what pressure would be sufficient to raise the door to the desired position. For example, the pressure sensor 1340 discussed in FIG. 13 might be used by the control electronics 1330 to close the control loop so that the control electronics can close the valve 1310 when a predetermined pressure is achieved. At step 1625 the control electronics 1330 evaluate whether the barrier is at the raised position. If not, the system proceeds back to step 1620 and opens the valve 1310 and adds more fluid. If the barrier has been raised to the desired position, the system may optionally proceed to a maintenance loop starting at step 1640. At step 1640 the system continuously monitors whether the barrier is at the desired position. Part of this step might include maintaining a certain fluid pressure, as discussed with respect to step 1570 in FIG. 15. If the barrier is at the desired position the system proceeds to step 1600. If not, the system proceeds to step 1610, where it evaluates whether to raise or lower the door.

If the control electronics 1330 determines that the barrier is to be lowered, the system proceeds to step 1630 and fluid is released from the air spring by putting the valve in the exhaust state, as discussed with respect to FIG. 13. Fluid can either be released continuously or in discrete increments, by identifying a target pressure or by opening a release valve for a period of time. As discussed above, the control electronics 1330 may use the pressure sensor 1340 discussed with respect to FIG. 13 to determine when a predetermined pressure has been achieved. The amount of fluid to be released may be predetermined, for example by using a learning system that identifies how much fluid must be released or what pressure would be sufficient to lower the door to the desired position. Step 1635 evaluates whether the barrier is at the lowered position. If not, the system proceeds back to step 1630 and releases more fluid. If the barrier has been lowered to the desired position, the system may optionally proceed to step 1640, where it enters the same position maintenance loop discussed above. Additional steps might be added to this process, and the process could be limited to include only steps 1600, 1610, 1620, and 1625 or limited to include only steps 1600, 1610, 1630, and 1635.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept. This will also be understood to encompass various combinations and permutations of the various components that have been set forth in these teachings.

What is claimed is:

1. A method of operating a fluid-based spring counterbalance mechanism comprising a flexible-walled fluid-based spring, the method comprising:

operatively coupling a rotatable input shaft of the fluid-based spring counterbalance mechanism to a jackshaft configured to be operatively coupled to a movable barrier such that rotation of the jackshaft raises or lowers the movable barrier;

applying a first force by a movable barrier operator to change the position of the movable barrier, wherein the flexible-walled fluid-based spring exerts a second force that supports a portion of the weight of the movable barrier in addition to the first force.

2. The method of operating a fluid-based spring counterbalance of claim 1, wherein the second force supports substantially an entire weight of the movable barrier.

3. The method of operating a fluid-based spring counterbalance of claim 1, further comprising:

identifying by a controller an entire weight of the movable barrier by observing a change in position of the movable barrier in response to adding fluid to the flexible-walled fluid-based spring.

4. The method of operating a fluid-based spring counterbalance of claim 3, further comprising varying by the controller a quantity of fluid in the flexible-walled fluid-based spring in response to identifying the entire weight of the movable barrier.

5. The method of operating a fluid-based spring counterbalance of claim 4, further comprising maintaining the second force by varying a quantity of fluid in the flexible-walled fluid-based spring.

6. The method of operating a fluid-based spring counterbalance of claim 5, wherein the varying the quantity of fluid is effected by connecting the flexible-walled fluid-based spring to a source of fluid.

7. The method of operating a fluid-based spring counterbalance of claim 1, further comprising:

measuring by a controller a temperature;

varying a quantity of fluid by the controller in response to a change in the temperature.

8. The method of operating a fluid-based spring counterbalance of claim 1, further comprising:

measuring by a controller a pressure of fluid contained within the flexible-walled fluid-based spring;

varying a quantity of fluid by the controller in response to a change in the pressure.

9. The method of operating a fluid-based spring counterbalance of claim 1, further comprising:

measuring by a controller a position of the movable barrier;

varying a quantity of fluid by the controller in response to a change in the position.

10. The method of operating a fluid-based spring counterbalance of claim 1, further comprising periodically varying a quantity of fluid within the flexible-walled fluid-based spring, by a controller.

11. The method of installing a fluid-based spring counterbalance of claim 1, wherein the portion of the weight of the movable barrier is transmitted to the flexible-walled fluid-based spring by:

a reduction shaft operably coupled to the rotatable input shaft, and a translational mechanism coupled to the reduction shaft, the translational mechanism configured to compress the flexible-walled fluid-based spring between two surfaces in response to rotation of the reduction shaft.

12. A method of counterbalancing a movable barrier by a flexible-walled fluid-based spring, the method comprising:

operatively coupling a flexible-walled fluid-based spring to a movable barrier such that a force exerted by the flexible-walled fluid-based spring supports at least a portion of a weight of a movable barrier;

securing a quantity of fluid within the flexible-walled fluid-based spring such that the flexible-walled fluid-based spring exerts a desired force when the movable barrier is at a particular position;

adjusting the quantity of fluid in the flexible-walled fluid-based spring such that the desired force remains substantially constant.

13. The method of counterbalancing a movable barrier by a flexible-walled fluid-based spring of claim 12 wherein the portion of the weight supported by the flexible-walled fluid-based spring varies with a position of the movable barrier.

14. The method of counterbalancing a movable barrier by a flexible-walled fluid-based spring of claim 12 wherein the force exerted by the flexible-walled fluid-based spring varies according to a position of the movable barrier.

15. The method of counterbalancing a movable barrier by a flexible-walled fluid-based spring of claim 12, wherein the adjusting further comprises adding a fixed quantity of fluid by a controller after a particular period of time.

16. The method of counterbalancing a movable barrier by a flexible-walled fluid-based spring of claim 15, wherein the adjusting further comprises:

detecting by a controller at least one input;

effecting by the controller the adjusting the quantity of fluid in response to the at least one input.

17. The method of counterbalancing a movable barrier by a flexible-walled fluid-based spring of claim 16, wherein the detecting the at least one input comprises detecting one or more of a temperature, a pressure, or a position of the movable barrier.

18. The method of counterbalancing a movable barrier by a flexible-walled fluid-based spring of claim 17, wherein the detecting one or more of the temperature or the pressure occurs in response to receiving an input indicating the movable barrier is in a predetermined position.

19. The method of counterbalancing a movable barrier by a flexible-walled fluid-based spring of claim 17, further comprising executing the detecting one or more of the temperature or the pressure at particular intervals of time.

20. The method of counterbalancing a movable barrier by a flexible-walled fluid-based spring of claim 16 wherein the effecting by the controller opens a valve to release fluid from the flexible-walled fluid-based spring or connects the flexible-walled fluid-based spring to a source of fluid.

* * * * *

UNITED STATES PATENT AND TRADEMARK OFFICE

CERTIFICATE OF CORRECTION

PATENT NO. : 9,103,149 B2
APPLICATION NO. : 14/467081
DATED : August 11, 2015
INVENTOR(S) : Brian Roy Skotty It is certified that error appears in the above-identified patent and that said Letters Patent is hereby corrected as shown below:

On the title page item (72); Delete "Elmnurst" and insert -- Elmhurst --, therefor.

Signed and Sealed this
Twenty-second Day of March, 2016

Michelle K. Lee

Michelle K. Lee
*Director of the United States Patent and Trademark Office*